US007874337B2

(12) United States Patent
Nilsson

(10) Patent No.: US 7,874,337 B2
(45) Date of Patent: Jan. 25, 2011

(54) DEVICE FOR APPLYING A SHEET OF MATERIAL

(75) Inventor: Ove Nilsson, Falkenberg (SE)

(73) Assignee: Core Link AB, Falkenberg (SE)

( * ) Notice: Subject to any disclaimer, the term of this patent is extended or adjusted under 35 U.S.C. 154(b) by 746 days.

(21) Appl. No.: 10/551,468

(22) PCT Filed: Mar. 26, 2004

(86) PCT No.: PCT/SE2004/000473

§ 371 (c)(1),
(2), (4) Date: Sep. 30, 2005

(87) PCT Pub. No.: WO2004/087551

PCT Pub. Date: Oct. 14, 2004

(65) Prior Publication Data

US 2006/0180696 A1 Aug. 17, 2006

(30) Foreign Application Priority Data

Apr. 1, 2003 (SE) ..... 0300963

(51) Int. Cl.
*B29C 65/00* (2006.01)

(52) U.S. Cl. ..... 156/446; 156/448; 156/449; 156/450; 156/455; 156/457; 156/458; 242/475.1

(58) Field of Classification Search ..... 156/195, 156/171, 172, 187, 188, 184, 392, 428–432, 156/446, 448–450, 455, 457, 458; 242/475.1; 226/108, 178, 179; 138/144
See application file for complete search history.

(56) References Cited

U.S. PATENT DOCUMENTS

| | | | | |
|---|---|---|---|---|
| 3,074,605 | A * | 1/1963 | Shaw | 414/746.3 |
| 3,260,390 | A * | 7/1966 | Morain | 414/432 |
| 3,322,291 | A * | 5/1967 | Smith | 414/432 |
| 3,664,531 | A * | 5/1972 | Magnusson et al. | 414/432 |
| 4,946,528 | A * | 8/1990 | Takahashi et al. | 156/187 |
| 6,231,711 | B1 * | 5/2001 | Roberts et al. | 156/188 |

* cited by examiner

*Primary Examiner*—Richard Crispino
*Assistant Examiner*—Christopher Schatz
(74) *Attorney, Agent, or Firm*—McGinn IP Law Group, PLLC

(57) ABSTRACT

The present invention relates to an apparatus for laying a material sheet on a number of cylindrical bodies, for example sleeves of paperboard or the like, which are employed within, int.al. the papermaking industry for winding a manufactured paper web, sheet web or the like, a conveyor being disposed to advance the cylindrical bodies in the longitudinal direction thereof to, past and away from a unit for supplying a material web to the bodies, and the conveyor being divided into at least two sections, of which the one is disposed to displace the cylindrical bodies in their longitudinal direction up to connection with the end of the preceding body, and of which the second section is disposed to positively rotate the cylindrical bodies about their longitudinal axis and displace the cylindrical bodies in the direction of their longitudinal axis during application of the material web, with the desired spacing between the edges of the applied material web.

16 Claims, 6 Drawing Sheets

DEVICE FOR APPLYING A SHEET OF MATERIAL

The present invention relates to an apparatus for laying a material sheet on a number of cylindrical bodies, for example cores or sleeves of paperboard or the like which are employed within, int. al. the papermaking industry, for winding a manufactured paper web, sheet web or the like. The invention further relates to use of the apparatus for preparing substantially spliced or joined sleeves which are also cut to the desired length, for example paperboard sleeves which are employed within, int. al. the papermaking industry for winding a manufactured paper web, sheet web and the like and a core or sleeve for application in the use of the apparatus according to the present invention.

In various contexts, and in particular within, int. al. the papermaking industry, it has become a steadily growing need to be able to splice or join and prepare sleeves of, above all, paperboard in order to be able to reuse sleeves that would otherwise be scrapped. However, very stringent demands are placed on the quality of the joined sleeves. This relates in particular to the joint itself which must be strong (display great mechanical strength in all axes) and which must maintain the sleeve parts aligned with each other and have the correct roundness. The demands on mechanical strength are particularly great, since a sleeve breakage may lead to serious accidents with both personal injury and sever machine damage as a result. In recent years, the quality demands have been further accentuated and in many cases, it is required that joined or spliced sleeves shall not, in principle, be distinguishable from homogeneous or unjoined sleeves as regards both appearance and mechanical strength. There is thus a great need in the art to realise an apparatus for rational handling of cylindrical bodies and preparation thereof with a material sheet or a material web or strip which is laid on the cylindrical bodies continuously in a helical line with the desired spacing between the edges of the material web.

The task forming the basis of the present invention is to satisfy the above-outlined wishes and needs by means of an apparatus for applying a material sheet, use thereof, as well as a sleeve for application in the employment of the apparatus.

This task is solved according to the present invention in that the apparatus intimated by way of introduction is given such characterising features that a conveyor is provided to feed the cylindrical bodies in the longitudinal direction thereof to, past and away from a unit for feeding a material web to the bodies, and that the conveyor is divided into at least two sections, of which the one section is disposed to displace the cylindrical bodies in their longitudinal direction up to connection to the end of a preceding body, and of which the second section is disposed to positively rotate the cylindrical bodies about their longitudinal axis and displace the cylindrical bodies in the direction of their longitudinal axis during the application of the material web, with the desired spacing between the edges of the applied material web. The one conveyor section is disposed to displace the bodies at a higher speed before the unit for applying the material web for connection of the bodies to the end of the preceding body and to permit slippage of the bodies after the connection to the end of the preceding body. The conveyor sections include a number of wheels disposed on either side of the bodies, the wheels being obliquely inclined to the longitudinal axis of the bodies for rotation and driving thereof towards, past and away from the unit for applying the material web. The wheels are rotary by means of a driving belt which extends around their periphery and on which the sleeve rests and which moreover extends to and around a drive pulley. The wheels are disposed pairwise and are obliquely inclined pairwise for regulating the advancement speed of the bodies. The wheel pairs in the one section of the conveyor may be obliquely inclined independently of the wheel pairs in the second section of the conveyor. The drive pulleys for the wheels on the one side are disposed on a common shaft and the shafts are interconnected with one another and a drive unit for synchronous driving of the shafts and thereby the pulleys and the obliquely adjustable wheels. The shafts in the one conveyor section are discrete and separate from the shafts in the second conveyor section in order to permit differentiated driving of the wheel pairs in the different sections. A knife is disposed to cut the applied material web at the end of the body after its passage of the unit for applying the material web during the conveying-off of the body therefrom. A number of wheels are disposed above the bodies at the unit for applying the material web for urging the bodies against the conveyor wheels. A trailing wheel is disposed for abutment against the cylindrical body flush with a point where the material web is laid on the cylindrical body. Use of the apparatus according to the foregoing for preparing substantially spliced or joined sleeves cut to the desired length, for example paperboard sleeves which are employed within, int. al. the papermaking industry for winding manufactured paper webs, sheet webs and the like is characterised in that the spliced or joined sleeves are placed in sequence after one another on the one section of the conveyor and are fed end-to-end under rotation about their longitudinal axis to, past and away from the unit for applying a material web in the second section of the conveyor with the desired spacing between the edges of the material web. The outside of the joined sleeves is ground prior to the application of the material web. The surface of the material web facing towards the outside of the joined sleeves is coated with glue prior to the application. The opposing side of the material web in relation to the glue is moistened for evening out tension in the glued material web. The female section of the sleeve joint on the sleeve parts is bevelled and the male section of the sleeve parts is bevelled, at least the one chamfer being coated with glue and the male section and female section being pressed together. The one sleeve part in the joint is bevelled from inside to outside and the other sleeve part is bevelled from outside to a distance from the inside for forming a space between the insides of the sleeve parts. The angle of the chamfer is flat, from 5° to 20°, preferably 10°, in relation to the longitudinal axis of the sleeve.

As a result of the present invention, a novel apparatus will be realised which permits laying of a material sheet, a material web or a material strip on a number of cylindrical bodies which are advanced continuously in sequence after one another in their longitudinal direction under rotation thereof about their longitudinal axis, with the desired spacing between the edges of the applied material strip which thereafter forms a helical covering sheet. The use of the apparatus according to the present invention makes for an extremely rational operation of specifically joined paperboard sleeves for winding a manufactured paper web, sheet web and the like. By the employment of the apparatus according to the present invention, there will be made possible a high degree of automation for achieving an extraordinarily favourable cost break-down. A sleeved joined and prepared according to the present invention displays an extremely high degree of quality and is extremely difficult to distinguish from a newly-manufactured, unjoined sleeve. In order to be able to distinguish a sleeve according to the present invention from a newly-manufactured sleeve, there is actually required an extremely in-depth optical examination thereof, and on many occasions a difference can only be detected from the inside of the sleeve.

The present invention will now be described in greater detail hereinbelow, with reference to the accompanying drawings.

The embodiment of the apparatus according to the present invention shown on the drawings will be described hereinbelow in connection with the preparation of joined sleeves of paperboard or similar material which are also cut to the desired length. The paperboard sleeves are intended for use within, int. al. the papermaking industry for winding a manufactured paper web, sheet web or the like. Nevertheless, the field of practical application is not restricted to such use, but encompasses all coating of cylindrical bodies with a material web or a material strip or a material sheet, with the desired spacing between the edges and so that the applied covering sheet forms a helical line. The cylindrical bodies may be homogeneous or hollow, thick- or thin-walled, long or short, etc., and may, after the application of the material sheet, be considered as forming a continuous cylindrical body, until the material sheet is cut at the ends of the bodies. According to the following description, the cutting of the material web takes place at the end of the body during displacement thereof with the applied covering sheet away from that position in the apparatus where the material sheet is applied and laid on the body.

Figure 5:
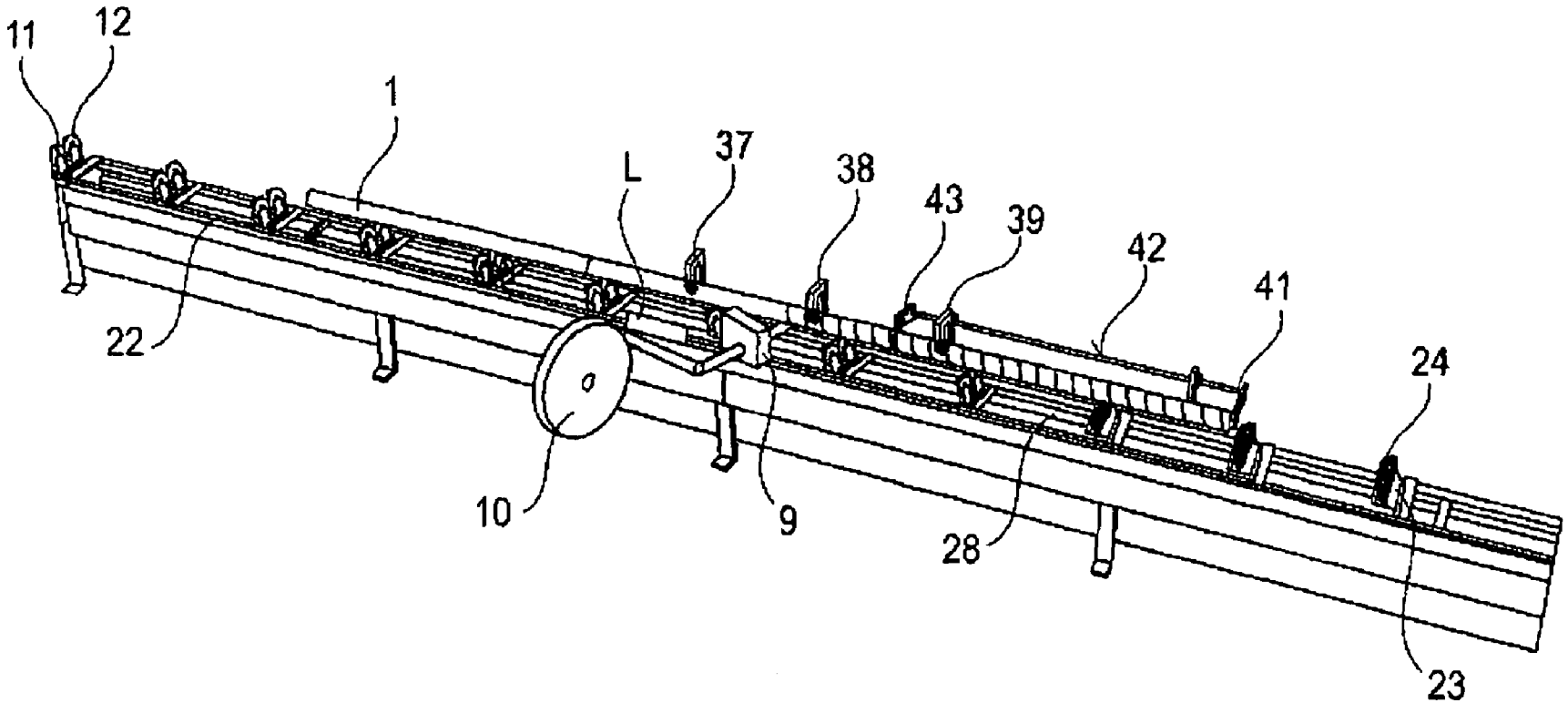
FIG. 5 is a perspective view of the embodiment of an apparatus according to the present invention illustrated in FIG. 2 in a different direction and with cladding and frame plates.
Figure 6:
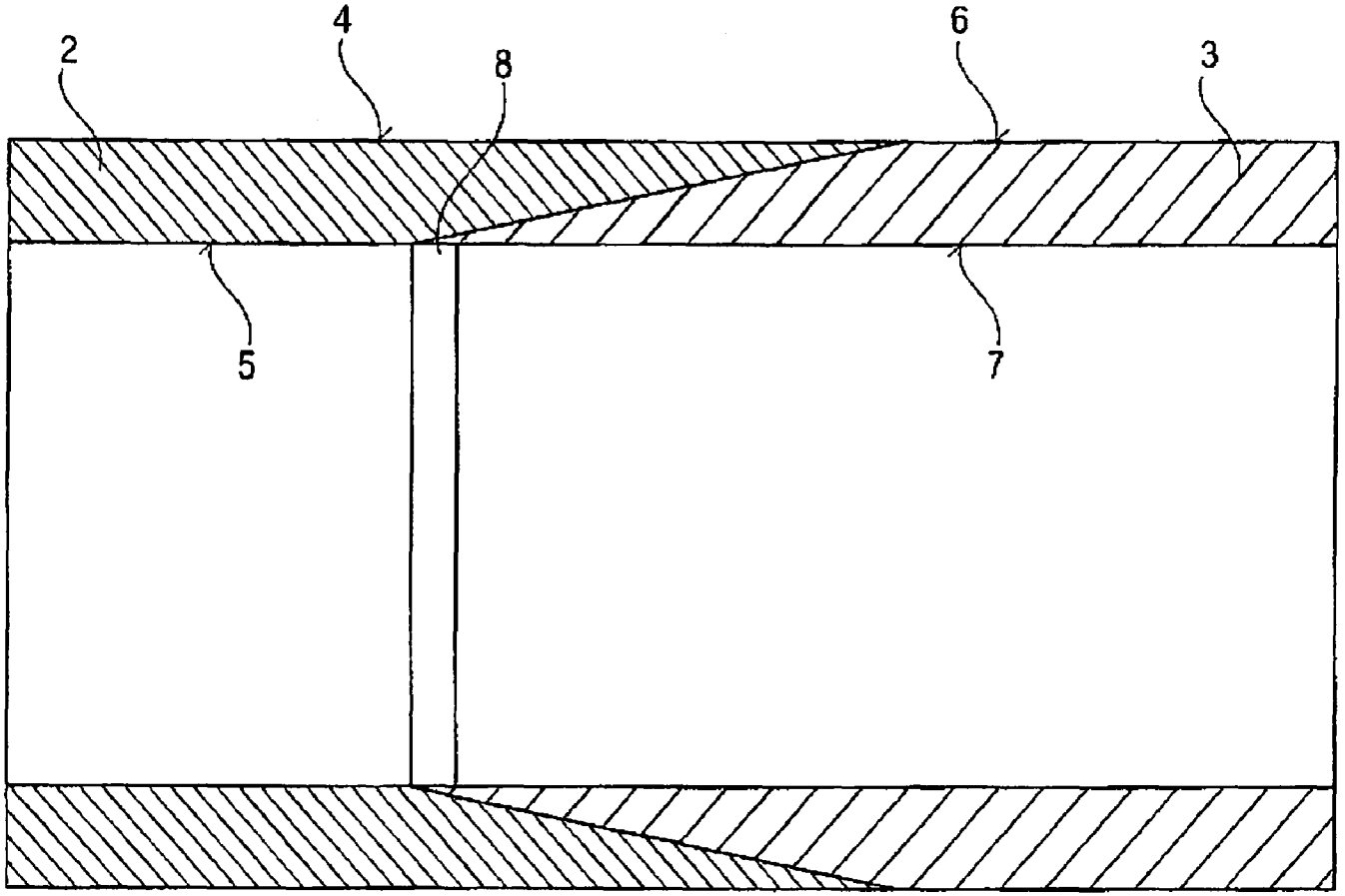
FIG. 6 is a cross section through a joint according to the present invention.

The sleeve 1 in the apparatus shown according to FIGS. 1 to 5 is joined together from a number of parts 2 and 3 according to FIG. 6. The ends of the sleeve parts 2 and 3 are prepared or bevelled as shown in FIG. 6, the sleeve part 2 being bevelled from the outside 4 to the inside 5 for forming a female part, while the sleeve part 3 is bevelled from the outside 6 to a distance from the inside 7 for forming a space 8. The chamfers on the sleeve parts 2 and 3 are pressed against one another to the position illustrated in FIG. 6 once one or both of the chamfers have been coated with a suitable glue, for example a dispersion glue or a PVA glue. It is also conceivable to apply the glue in the form of one or more glue strands, the one glue strand optionally consisting of a hot melt glue, while the other glue strand consists of a glue possessing such properties that the glue wets the sleeve material and penetrates in between the fibres and sets, for example by drying. The space or cavity 8 serves for accommodating glue possibly forced out on the pressing together of the sleeve parts 2 and 3. The joint illustrated in FIG. 6 is also characterised in that it is long for achieving such a degree of strength in the glue union that it displays greater mechanical strength than the basic material itself in the sleeve. Further, the joint is conical and has a smooth and clean surface which gives a good purchase for the glue. The space or cavity 8 accommodates, as was mentioned above, any possible excess glue so that this does not penetrate into the sleeve and obstruct any possible internal chucks which are employed on rewinding paper at a papermill, or such chucks as are employed in printing presses. The cavity 8 will moreover give a straight inner line. Without the cavity 8, there is a risk that the inner conical tip will slide over and in on the inside 5 of the sleeve part 2 on compression of the sleeve parts 2 and 3 against one another. It is of the utmost importance that the inner dimensions of the sleeve are maintained.

The joint according to the present invention described with reference to FIG. 6 is particularly appropriate, but sleeves combined together with the aid of other joints can naturally also be processed in an apparatus according to the present invention.

The joined sleeves are advantageously to be ground, for example centreless ground, and thereafter cut to the desired length. The joined, ground and also cut sleeves can be magazined or fed direct to an apparatus according to the present invention, one embodiment of such an apparatus being shown in greater detail in FIGS. 1 to 5.

Figure 1:
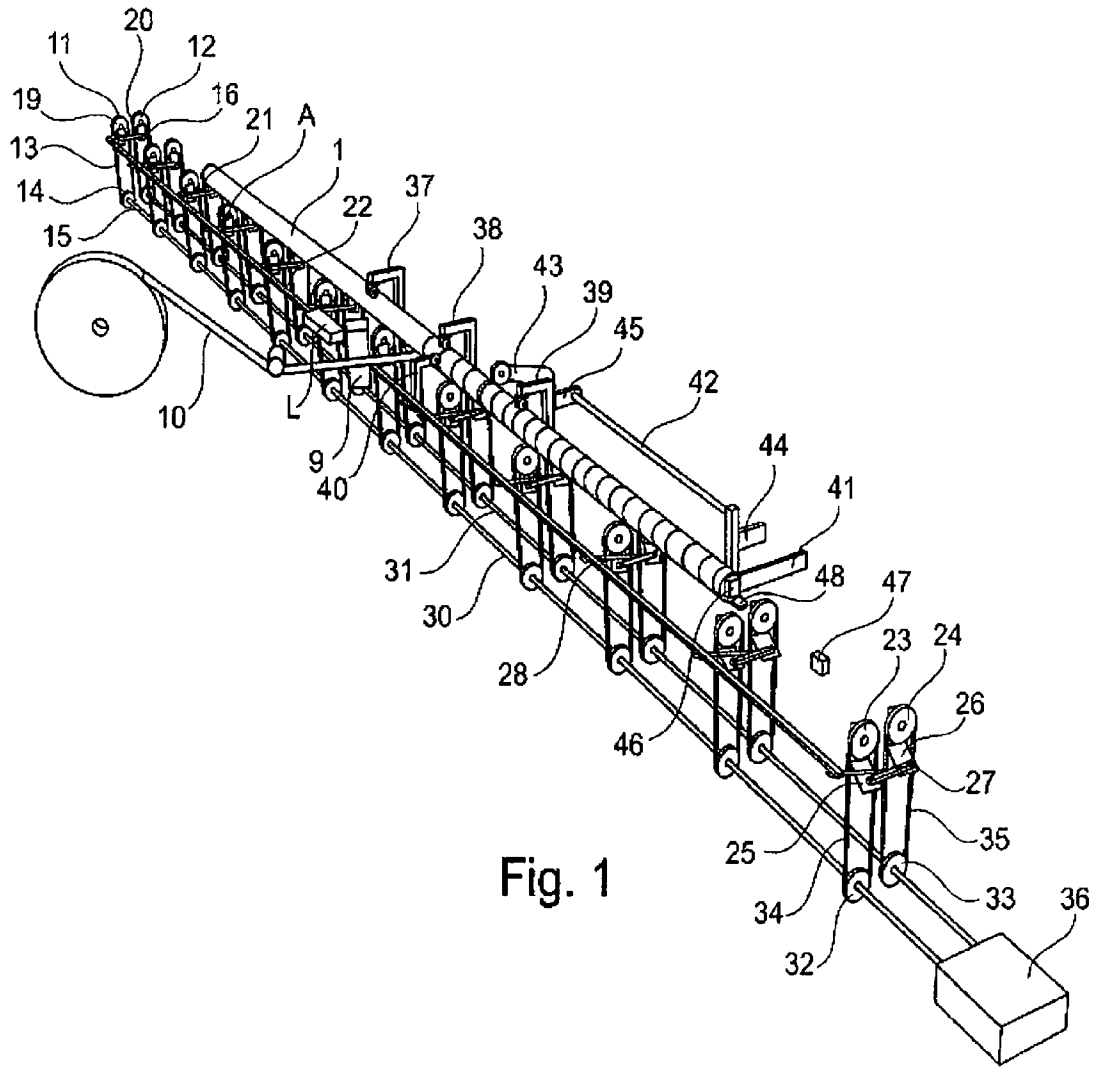
FIG. 1 is a perspective view of an apparatus according to one embodiment of the present invention.
Figure 2:
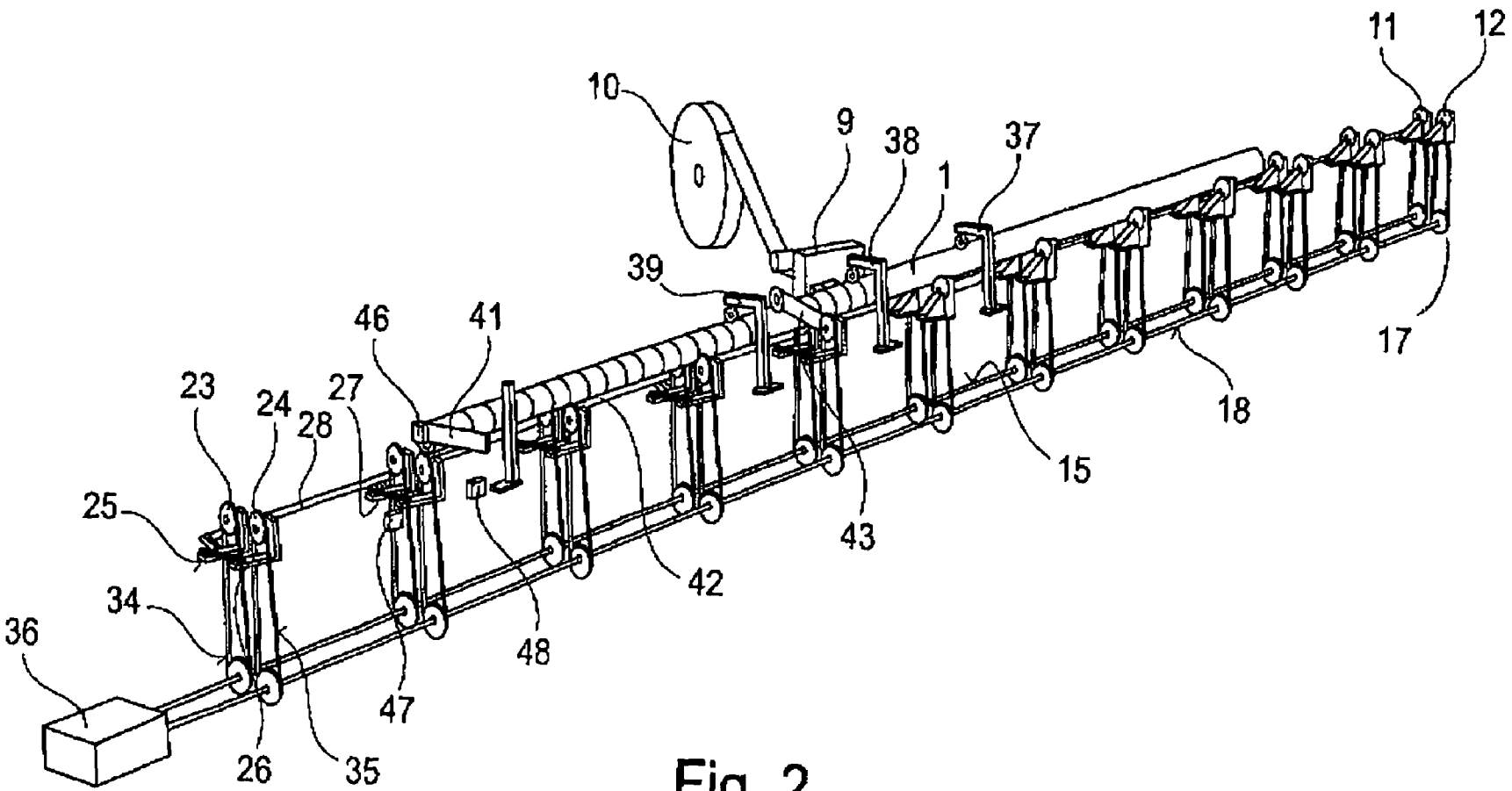
FIG. 2 is a similar perspective view from the opposite direction.
Figure 3:
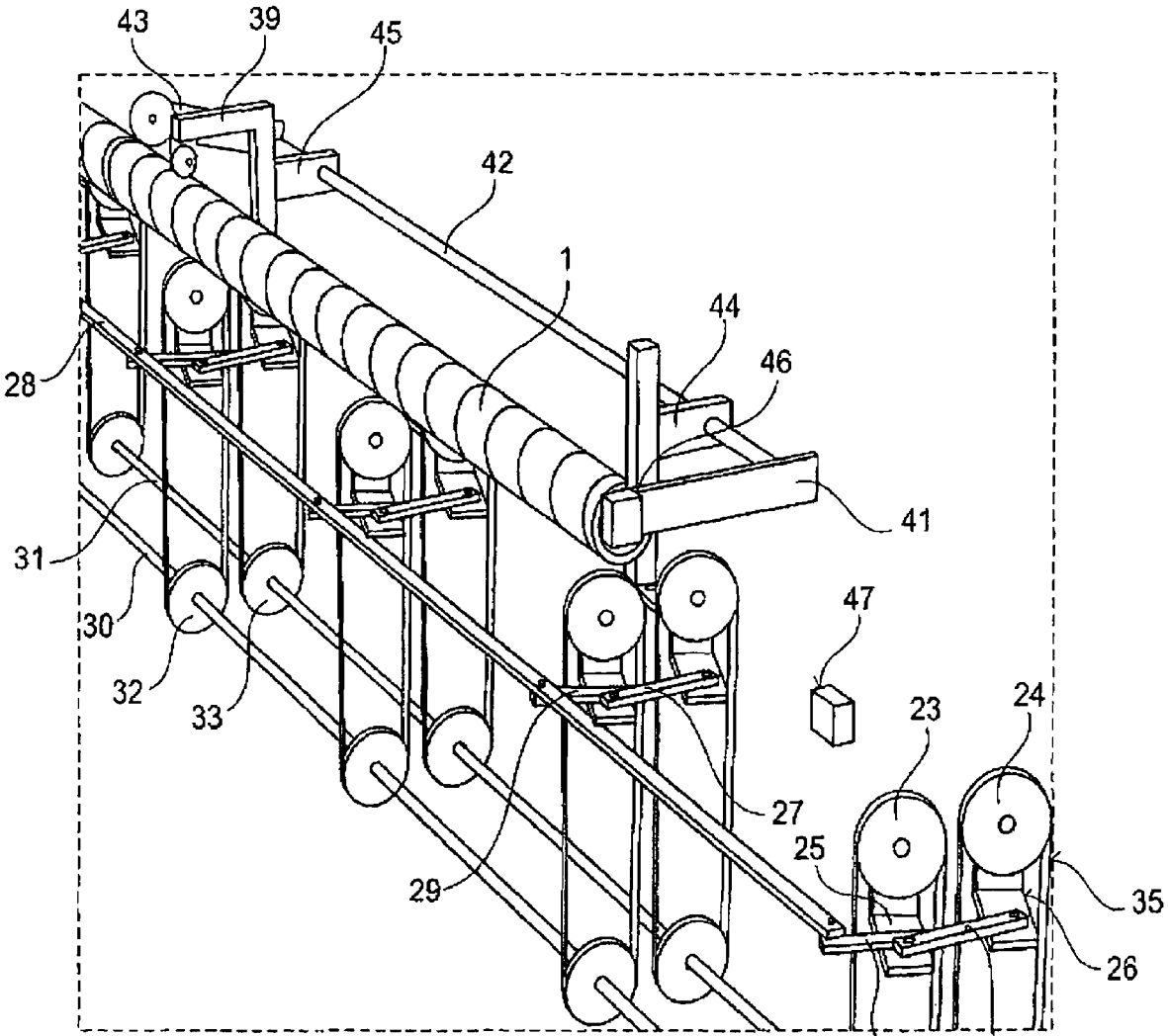
FIG. 3 is a perspective view on a larger scale of a part of the apparatus illustrated in FIG. 1.
Figure 4:
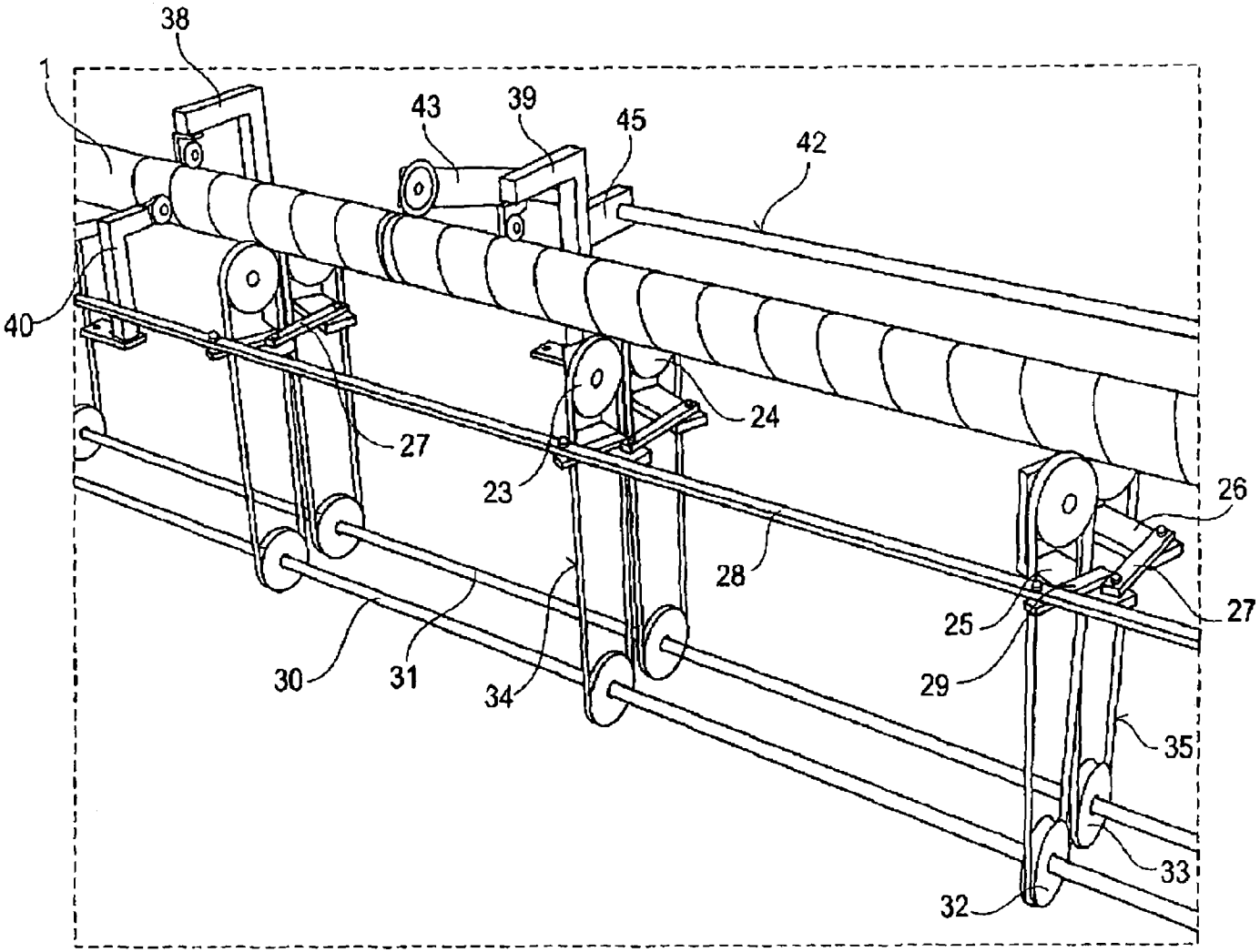
FIG. 4 is a perspective view in another direction of substantially the same part of the apparatus as shown in FIG. 3.

The apparatus according to the present invention illustrated in FIGS. 1 to 5 comprises a conveyor which, according to FIG. 1, displaces a joined sleeve 1 in its longitudinal direction from left to right past a unit 9 for applying a material web 10 on the outside of the joined sleeve 1. The unit 9 may, in addition to guide and tensioning rollers, include a per se known glue applicator and moisturiser unit. The left hand part or section of the conveyor in FIG. 1 includes six pairs of conveyor wheels 11 and 12. The one wheel 11 in each pair is located on the one side of the paperboard sleeve 1 and the other wheel 12 in each pair on the opposing side of the paperboard sleeve 1. The wheels 11 are connected via driving belts 13 to drive wheels 14 on a shaft 15, while the wheels 12 are connected to a shaft 18 via a drive wheel or pulley 17 and a driving belt 16. The conveyor wheels 11 and 12 are rotatably mounted each on their bracket 19 and 20. The brackets 19 and 20 are pivotally mounted on a frame and are interconnected to each other via an intermediate section 21. For simultaneous pivoting of all of the brackets 19, 20, at least the one bracket 19 is connected to a rod 22 extending along the conveyor, via an arm A to the one bracket 19 in each pair. By displacing the rod 22 in the longitudinal direction of the conveyor, the conveyor wheels 11 and 12 will thus be obliquely inclined to the desired degree. This oblique inclination permits adjustment and regulation of the speed with which the sleeves are fed towards the sleeve lying ahead. It is of crucial importance that the subsequent sleeve 1 catches up with the sleeve ahead before the sleeve ends abutting against one another reach the unit 9. It is further of importance that the subsequent sleeve or sleeves can slip on the wheels 11, 12 and/or the driving belts 13, 16.

The driving belts 13 and 16 may be given different properties for the desired handling of the sleeve 1, for example the driving belts 13 and 16 may be designed so that they do not reach up to the periphery of the wheels 11 and 12 and, as a result, do not act on the sleeve 1, but they may also extend up over the periphery of the wheels 11 and 12 for engagement with the sleeve 1 and displacement thereof in the longitudinal direction of the conveyor. The surface of the driving belts 13, 16 and/or the wheels 11, 12 may be of low-frictional type, so that slipping is permitted between them and the sleeve 1. However, the friction should be so great that the sleeve 1 is displaced in the longitudinal direction of the conveyor in contact with the end of a sleeve lying ahead, before the end reaches the unit 9 where application of the material web 10 is commenced.

The part of the conveyor located substantially in register with the applicator unit 9 and to the right thereof is of substantially the same design and construction as the above-described part of the conveyor to the left in FIG. 1. The right-hand part of the conveyor also includes six conveyor wheel pairs 23, 24, the wheels 23, 24 being rotatably mounted each on a bracket 25, 26. The brackets 25, 26 are pivotally mounted on a frame section and interconnected with one another by means of a rod 27. The one bracket 25 in each pair is connected to a rod 28 extending along the conveyor, by the intermediary of an arm 29. The wheels 23, 24 are each connected to their shaft 30, 31 via drive wheels 32, 33 and each respective driving belt 34 and 35.

As will be apparent from FIG. 1, the shafts 30 and 31 may be common with the shafts 15 and 18, and the shafts 30 and 31 may be connected to a drive unit 36 for driving the shafts 15, 18, 30, 31 at the desired speed. The rod 28 serves for oblique inclination of the conveyor wheels 23, 24 in each pair for adjusting and regulating the speed with which the sleeves 1 are displaced during the application of the material web 10. The displacement of the sleeves 1 during and after the application of the material web 10 must be positive so that the sleeve is moved away from the unit 9 even when a displacement-counteracting force is exercised from the material web 10. This is facilitated in that there are provided three trailing wheels 37, 38 and 39 at the unit 9 for applying the material web 10, each on the end of its arm which extends from the frame of the conveyor to a position straight above the sleeve 1, and the wheels 37, 38 and 39 serve for urging the sleeve 1 against the conveyor wheel pairs 23 and 24 so as to counteract or prevent slipping of the sleeve 1 during and after its passage of the unit 9 for application of the material web 10. At the intermediate trailing wheel 38, there is an additional trailing wheel 40 on an arm which extends up from the frame of the conveyor and supports against the sleeve substantially immediately after the application of the first turn of the material web 10, the purpose being that the end of the sleeve 1 proper is not to be bent and pressed in a direction towards the unit 9 because of the tension or tractive force from the material sheet or web 10.

After passage of the unit 9 for applying the material web 10, the sleeve 1 is advanced to a carrier 41 which is secured on the end of a rod 43 which, at its opposing end, carries an arm 45 with a knife and which is displaceable in its longitudinal direction in brackets 44 and 45. The knife may appropriately be rotary. The distance between the arm 41 and the arm 43 with the knife is the same as the length of the sleeve 1. As soon as the sleeve 1 has reached the arm 41, the arm 43 with the knife will be pivoted down towards the sleeve so that the rotary knife at its end will cut the material sheet or web 10. The arm 41 may naturally be combined with different types of positional sensors 46, 47 and 48 which serve the purpose of indicating for any possible regulator equipment where the prepared sleeve is located on the conveyor for actuating other units in the apparatus or the plant.

FIG. 1 shows the material web 10 applied from the underside of the sleeve 1, but it may naturally also be applied from the upper side of the sleeve 1. In that the sleeve 1 is both rotated and displaced in its longitudinal direction on the conveyor according to FIGS. 1 and 2, the material web 10 will be applied on the sleeve 1 in helical configuration. The speed of rotation and speed of longitudinal displacement may be regulated in a multiplicity of different ways. For example, the wheel pairs 11, 12 and 23, 24 may be given different diameters, may be angled in different ways, etc. The rods 22, 28 for angular inclination of the conveyor wheel pairs 11, 12 and 23, 24 may be adjusted in a multiplicity of different ways. For example, they may be provided with a threaded end portion for interconnection with a nut or the like. This is shown in FIGS. 1 and 5 quite simply by a box L into which the rods 22 and 28 extend and in which are disposed per se known devices for displacing the rods 22, 28 individually or also together.

In the apparatus according to the present invention shown on the drawings, the sleeve 1 will thus rest on obliquely inclined wheels 11; 12 and 23, 24 whose function is to support the sleeve 1, advance the sleeve 1 forwards in the apparatus, as well as to rotate the sleeve 1. As a result of the advancement and rotating movement of the sleeve, it is possible to apply thereon a material sheet or web 10 in a spiral or helix. It is naturally important that the sleeve 1 overhauls the preceding sleeve, but thereafter slips. In that the oblique inclination of the wheels 11, 12 and 23, 24 may be put into effect with a high degree of precision, it is possible to apply the material sheet or web 10 with a pre-determined pitch for attaining a desired and uniform spacing between the turns or the edges between the turns. It is of importance for the user that there is no excessive distance between the sheets, since, in such an event, a pattern can occur on the lower layers of the paper on winding. Moreover, it is of importance that the material sheet or web 10 does not overlap the material sheet 10 in the preceding turn, since this would also give rise to patterns in the paper layers located most proximal the sleeve.

As was mentioned above, it is of importance that the wheels 11, 12 after the applicator unit 9 display a higher peripheral speed than the wheels 23, 24 ahead of them. This is because the sheet has imparted a greater diameter to the sleeve. The higher peripheral speed may also be achieved in other ways, for example a higher speed of rotation or by a larger radius of the wheels 23, 24 than the wheels 11, 12 ahead of the sheet applicator unit 9. It is also appropriate to take into account the larger diameter of the sleeve 1 after the application of the covering sheet or material web 10.

The employment of an apparatus according to the present invention may proceed as follows. The sleeve 1 is placed in the infeed section to the left of the applicator unit 9, whereupon the sleeve 1 accelerates so that it overhauls the preceding sleeve. The sleeve 1 lies loosely on the advancement wheels 11, 12. The sleeve 1 arrives at the sheet applicator unit 9, where the speed is constant, since the sleeve has superjacent wheels 37, 38, 39 which, with a pre-determined compression force, entail that the sleeve 1 follows the speed of the obliquely inclined wheels 23, 24 with great accuracy, while overcoming the braking force that is exercised by the material web or sheet 10. The material sheet 10, which has been coated with glue on the one side, fixes in the outer layer of the sleeve 1. An accompanying knife cutter 41, 42, 43 cuts the material sheet 10 in the division between the sleeves. In order to find the division between the sleeves, a guide 41 follows the front end of the sleeve. Causing a knife 43 to follow the sleeve 1 in this manner for cutting the entire sleeve thickness is prior art technology, but this is applied in this case only for cutting the material sheet 10.

As was mentioned above, it may be appropriate, at least at the ends of the sleeves, to moisten the material sheet 10 on the opposing side in relation to the glued side, for counteracting tension in the material sheet 10 which could otherwise be caused by the fact that there is water-soluble glue on the one side but none on the opposing side. Without moistening, there is a risk that the sheet 10 will bend upwards and outwards from the sleeve 1 which may result in the sheet 10 coming loose and rising up at the ends of the sleeve 1 after the cutting of the sheet 10. The gluing in the unit 9 preferably takes place using a pre-gluing unit, spray nozzle, slit glue orifice or the like which distributes the glue uniformly over the one side of the sheet 10 without forming droplets or glue running along the edge of the sheet. The glue is preferably PVA glue, but glue of other compositions may also occur, for example sodium silicate and dextrin. The material sheet 10 may also have its one side pre-glued in order subsequently to be moistened just before the application. The moistening may be put into effect by a spray, contact roller or dipping. Also in this case, it is appropriate to moisten the opposing side in relation to the glued side. The material sheet 10 may also be provided with a glue or adhesive in the same manner as an adhesive strip that is moistened for activating the adhesive or glue, or of tape type.

The apparatus may, according to FIGS. 5, be built on a frame which consists int. al. of profile plates which extend on both sides thereof and are interconnected with one another.

It has proved to be suitable that the displacement speed of the sleeves 1 is adjustable in the different sections of the conveyor for attaining the desired result in the form of a uniform covering sheet with the desired distance between the edges. In the apparatus according to the present invention, it is easy to realise the desired adjustments by oblique inclination of the wheel pairs in the different sections and by the possibility of slipping in the first section and substantially positive displacement in the second section during and after the application of the material sheet or web 10.

Many modifications are naturally possible without departing from the scope of the inventive concept as this is defined in the appended claims.

The invention claimed is:

1. An apparatus for laying a material sheet on a plurality of cylindrical bodies including first and second cylindrical bodies, comprising:

a unit for applying a material web to the cylindrical bodies; and a conveyor disposed to advance the cylindrical bodies in a longitudinal direction thereof, to, past and away from said unit, the conveyor comprising:

a first section comprising a plurality of wheels for rotating and advancing said cylindrical bodies, said first section being disposed to displace the cylindrical bodies in their longitudinal direction and connect the first cylindrical body of said plurality of cylindrical bodies with an end of the second cylindrical body of said plurality of cylindrical bodies which precedes the first cylindrical body;

a second section comprising a plurality of wheels for rotating and advancing said cylindrical bodies, said second section being connected to said first section and operating independent of said first section, and being disposed to positively rotate the cylindrical bodies about their longitudinal axis and displace the cylindrical bodies in the direction of their longitudinal axis during said applying of the material web, with a desired spacing between edges of the applied material web; and a first plurality of drive pulleys formed on a first side of the first and second sections and a second plurality of drive pulleys formed on a second side of the first and second sections, the plurality of wheels of said first and second sections comprising:

a first plurality of wheels formed on the first side and being rotated by a first plurality of driving belts formed around the first plurality of drive pulleys; and a second plurality of wheels formed on the second side and being rotated by a second plurality of driving belts formed around the second plurality of drive pulleys, wherein said first section displaces the bodies ahead of the unit for applying the material web to connect the first cylindrical body to the end of the second cylindrical body and permits slipping of the bodies after the connection of the first cylindrical body to the end of the second cylindrical body, wherein said first and second plurality of wheels are disposed on a side of the bodies, the wheels being obliquely inclinable in relation to the longitudinal axis of the bodies for rotation and driving thereof towards, past and away from the unit for applying the material web, and wherein the apparatus further comprises a plurality of trailing wheels which are provided above and along the bodies at the unit for applying the material web for urging the bodies against said plurality of wheels.

2. The apparatus as claimed in claim 1, wherein the cylindrical bodies rest on the first and second plurality of driving belts.

3. The apparatus as claimed in claim 1, wherein the wheels are arranged pairwise and are obliquely inclined for regulating the advancement speed of the bodies.

4. The apparatus as claimed in claim 3, wherein the wheel pairs in the first section of the conveyor are obliquely inclinable independently of the wheel pairs in the second section of the conveyor.

5. The apparatus as claimed in claim 2, wherein the drive pulleys for the wheels on the first side of the first and second sections are disposed on a first common shaft and the drive pulleys for the wheels on the second side of the first and second sections are disposed on a second common shaft which is interconnected with said first common shaft, and wherein a drive unit provides synchronous driving of the first and second common shafts and thereby the pulleys and the obliquely inclinable wheels.

6. The apparatus as claimed in claim 5, wherein the first and second common shafts in the first section are discrete and separate from the first and second common shafts in the second section in order to permit differentiated driving of the wheel pairs in the first and second sections.

7. The apparatus as claimed in claim 1, further comprising:

a knife which is arranged to cut the applied material web at an end of the bodies after passage of the unit for applying the material web during conveying-off of the bodies therefrom.

8. The apparatus as claimed in claim 1, further comprising:

a trailing wheel which is provided for abutment against the first cylindrical body flush with a point where the material web is applied to the first cylindrical body.

9. The apparatus as claimed in claim 1, wherein said plurality of wheels in said first section are inclinable independent of said plurality of wheels in said second section.

10. A conveyor for advancing plural cylindrical bodies in a longitudinal direction thereof, comprising:

a first section comprising a plurality of wheels for rotating and advancing said cylindrical bodies, said first section being disposed to displace a first cylindrical body of said plural cylindrical bodies in said longitudinal direction up to connection with the end of a second body of said plural cylindrical bodies which precedes said first cylindrical body; and a second section comprising a plurality of wheels for rotating and advancing said cylindrical bodies, said second section being connected to said first section and operating independent of said first section, and disposed to positively rotate the plural cylindrical bodies about their longitudinal axis and displace the plural cylindrical bodies in a direction of their longitudinal axis during applying of a material web, with a desired spacing between edges of an applied material web; and a first plurality of drive pulleys formed on a first side of the first and second sections and a second plurality of drive pulleys formed on a second side of the first and second sections, the plurality of wheels of said first and second sections comprising:

a first plurality of wheels formed on the first side and being rotated by a first plurality of driving belts formed around the first plurality of drive pulleys; and a second plurality of wheels formed on the second side and being rotated by a second plurality of driving belts formed around the second plurality of drive pulleys, wherein said first section displaces the bodies ahead of the unit for applying the material web to connect the first cylindrical body to the end of the second cylindrical body and permits slipping of the bodies alter the connection of the first cylindrical body to the end of the second cylindrical body, wherein said first and second plurality of wheels are disposed on a side of the bodies, the wheels being obliquely inclinable in relation to the longitudinal axis of the bodies for rotation and driving thereof towards, past and away from the unit for applying the material web, and wherein the conveyor further comprises a plurality of trailing wheels which are provided above and along the bodies at the unit for applying the material web for urging the bodies against said plurality of wheels.

11. The conveyor of claim 10, wherein the first and second cylindrical bodies rest on the first and second plurality of driving belts.

12. The conveyor of claim 11, wherein the first and second plurality of wheels comprise plural pairs of wheels which are obliquely inclined for regulating the advancement speed of the bodies.

13. The conveyor of claim 12, wherein the plural pairs of wheels in the first section are obliquely inclinable independently of the plural pairs of wheels in the second section.

14. The apparatus as claimed in claim 1, wherein an end of the first cylindrical body comprises a first bevelled end, and the end of the second cylindrical body comprises a second bevelled end which is bevelled in a direction opposite to a direction of the first bevelled end and is connected by the apparatus to the first bevelled end.

15. The apparatus as claimed in claim 14, wherein the plurality of wheels regulate the advancement speed of the first and second cylindrical bodies such that the first and second bevelled ends are joined to form a joint, and the unit for applying the material web applies the material web on the joint.

16. The apparatus as claimed in claim 1, further comprising:

a plurality of rods, the plurality of wheels being mounted on arms coupled together and adjustable by the rods.

* * * * *